US005890375A

United States Patent [19]

Ståhl et al.

[11] Patent Number: 5,890,375

[45] Date of Patent: Apr. 6, 1999

[54] ARRANGEMENT AT A TUBE EVAPORATOR

[75] Inventors: Mauri Ståhl, Hägersten; Per Wedby, Bromma, both of Sweden

[73] Assignee: Aktiebolaget Electrolux, Stockholm, Sweden

[21] Appl. No.: 945,299

[22] PCT Filed: Feb. 20, 1997

[86] PCT No.: PCT/SE97/00286

§ 371 Date: Oct. 16, 1997

§ 102(e) Date: Oct. 16, 1997

[87] PCT Pub. No.: WO97/32169

PCT Pub. Date: Sep. 4, 1997

[30] Foreign Application Priority Data

Feb. 28, 1996 [SE] Sweden ..... 9600770

[51] Int. Cl.[6] ..... F25B 41/06

[52] U.S. Cl. ..... 62/511; 62/527

[58] Field of Search ..... 62/511, 527; 138/44

[56] References Cited

U.S. PATENT DOCUMENTS

| | | | |
|---|---|---|---|
| 2,776,550 | 1/1957 | Magester | 62/527 |
| 2,776,552 | 1/1957 | Thomas | 62/511 |
| 2,956,421 | 10/1960 | Stevens | 62/511 |
| 3,172,272 | 3/1965 | Slaing | 62/511 |
| 3,820,571 | 6/1974 | Grier | 138/44 |
| 5,269,158 | 12/1993 | Bitter et al. | 62/511 |
| 5,345,780 | 9/1994 | Aaron et al. | 62/511 |

FOREIGN PATENT DOCUMENTS

| | | |
|---|---|---|
| 2822149 | 11/1979 | Germany . |
| 9514197 | 5/1995 | WIPO . |
| 9617213 | 6/1996 | WIPO . |

*Primary Examiner*—William E. Tapoical
*Attorney, Agent, or Firm*—Pearne, Gordon, McCoy & Granger LLP

[57] ABSTRACT

An evaporator (10), e.g. in a domestic refrigerator, for refrigerating air in a space for goods, which space is confined against ambient atmosphere (14) by a wall (16), is constituted by a tubular element (18), through which a refrigerant flows from a capillary pipe (20), which is connected to the element at a joint (28) at one end of the element. The element (18) comprises an inner tube (24), through which the refrigerant flows, outside which inner tube an outer tube (26) is arranged, the outer tube (26) extending through the wall (16) and the joint (28) being arranged between the capillary pipe (20) and the inner tube (24) inside the wall (16) in a chamber (38) formed in the outer tube (26). A sealing means (36) arranged between the capillary tube (26) prevents humidity of the ambient atmosphere (14) from forcing its way into the chamber (38). If a leakage would arise in the joint (28) the refrigerant will leak out into the chamber (38) and can thus not enter the goods compartment in the refrigerator and cause a fire or explosion there.

1 Claim, 2 Drawing Sheets

ARRANGEMENT AT A TUBE EVAPORATOR

The invention refers to an arrangement at an evaporator, e.g. in a domestic refrigerator, for refrigerating air in a space, which is confined against ambient atmosphere by a wall, the evaporator, which is part of a compression refrigerating circuit, being constituted by a tubular element, through which a refrigerant flows from a capillary pipe included in the circuit, which pipe is connected to the element at a joint at one end of the element.

At such an evaporator the joint uses to be located in the space. If a leakage arises in the joint, the refrigerant in the circuit will leak out into the space, which at a domestic refrigerator communicates with a goods compartment closed by the door of the refrigerator, in which compartment goods are stored in the refrigerator. If the refrigerant is inflammable and has leaked out through the joint into the goods compartment closed by the door, the refrigerant forms with the air in the goods compartment a gas mixture, which by an electric spark from some electric component in the goods compartment can be brought to explode.

The object of the invention is to arrange the joint such, that refrigerant possibly leaking out through it will not enter the goods compartment.

This object is reached by the arrangement according to the invention by the tubular element comprising an inner tube, through which the refrigerant flows, that an outer tube is arranged on the outside of the inner tube, that at said one end of the element the outer tube extends through the wall and that the joint is arranged between the capillary pipe and the inner tube, the joint being located inside the wall in a chamber formed in the outer tube, and that a sealing means is arranged between the capillary pipe and the outer tube for preventing humidity of the ambient atmosphere from forcing its way into the chamber.

By the sealing means humidity from the ambient atmosphere is prevented from forcing its way into the chamber and there form ice, which can damage the outer tube and the joint.

Figure 1:
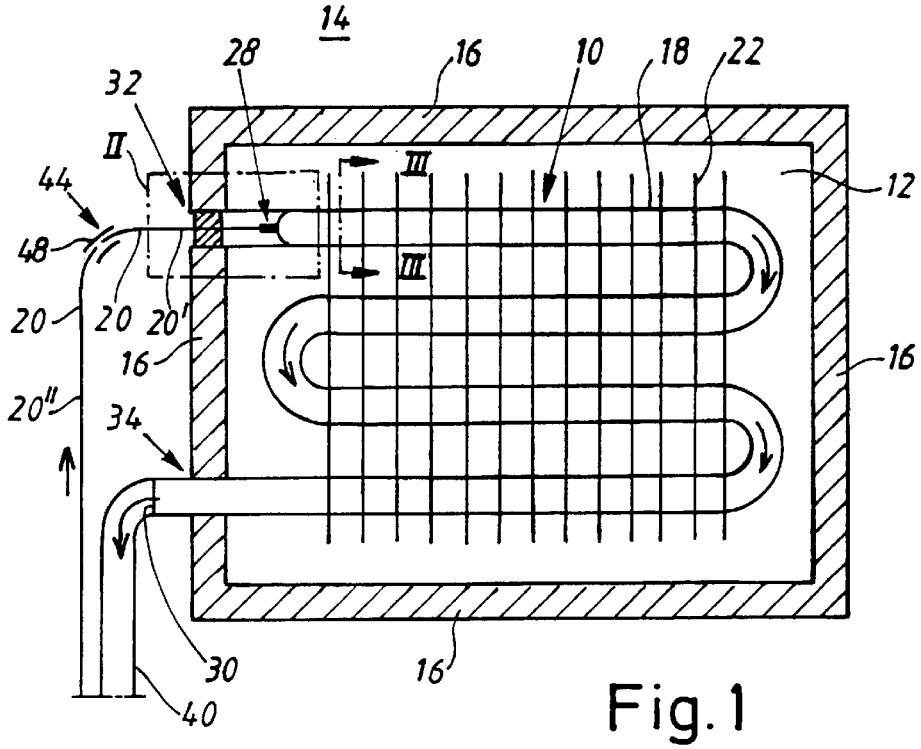
Figure 2:
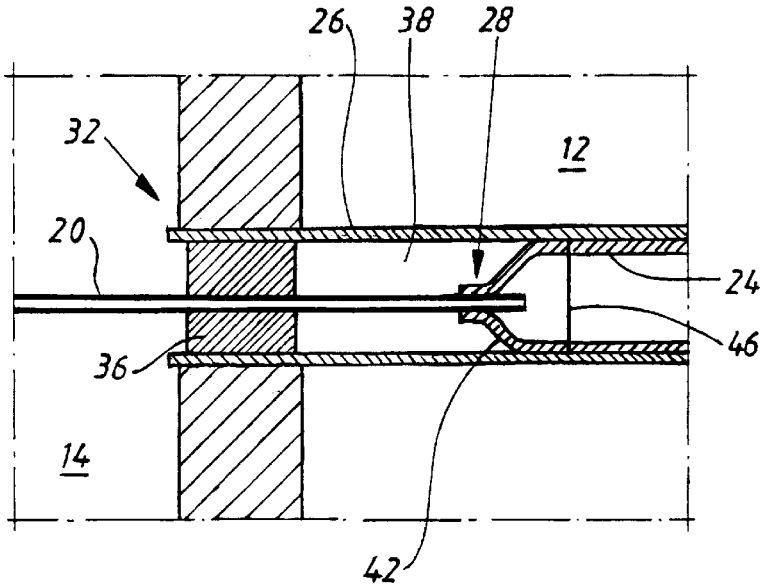
Figure 3:
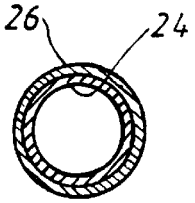
Figure 4:
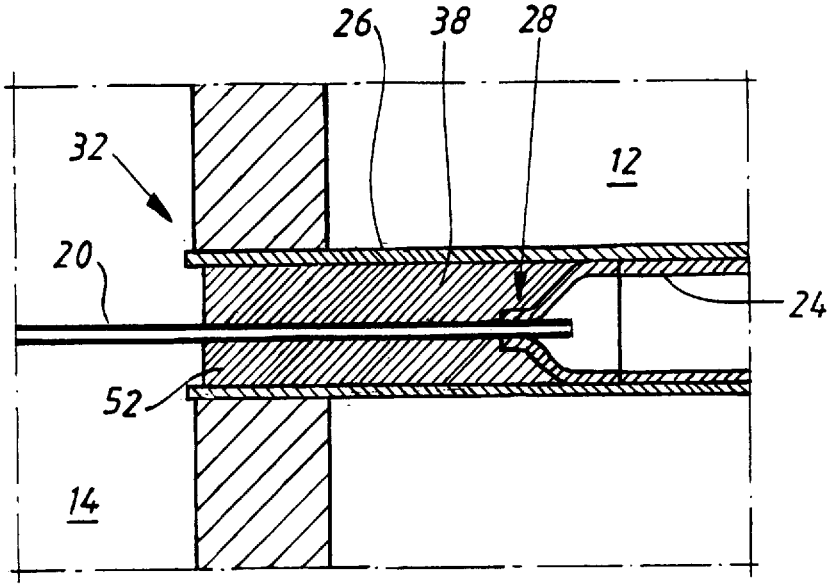
Figure 5:
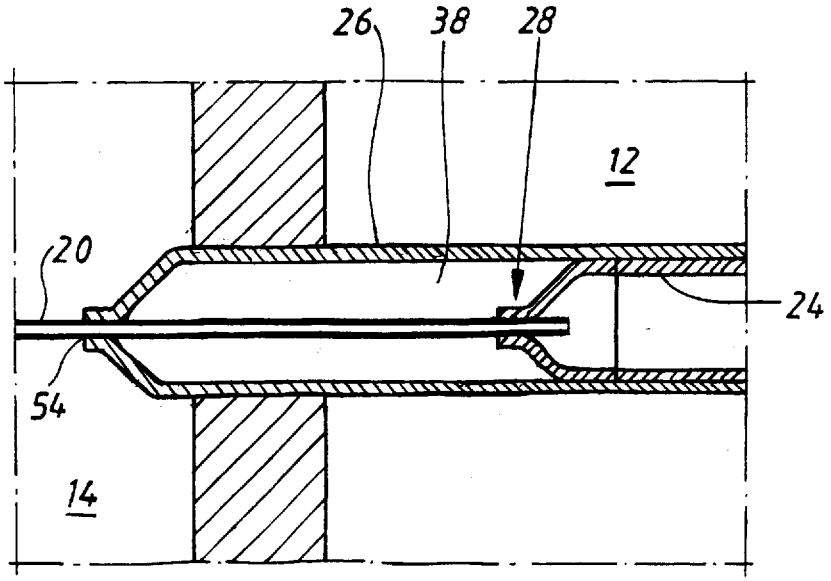

Embodiments of arrangements according to the invention are described below in connexion with the enclosed drawings, in which FIG. 1 shows a first embodiment of an evaporator arranged in a space, FIG. 2 shows an enlargement of a longitudinal sectional view of a part II in FIG. 1, FIG. 3 shows an enlargement of a sectional view according to the marking III—III in FIG. 1, FIG. 4 shows in the same sectional view as FIG. 2 a second embodiment of the evaporator, and FIG. 5 shows in the same sectional view as FIG. 2 a third embodiment of the evaporator.

With reference to FIG. 1 10 designates an evaporator for refrigerating air in a space 12 in a domestic refrigerator, which space communicates with a not shown compartment for storing goods in the refrigerator and is confined against ambient atmosphere 14 by a wall 16: The evaporator 10 is part of a compression refrigerating circuit, which shows a tubular element 18, through which a refrigerant flows from a capillary pipe 20. The element 18, which is provided with surface-enlargening flanges 22, is constituted by an inner tube 24 and an outer tube 26. The refrigerant flows through the inner tube 24, which runs inside the outer tube 26 from a joint 28 with the capillary pipe 20 to a joint 30 at the outlet of the evaporator 10. The ends of the outer tube 26 run at as well the inlet 32 of the evaporator as at its outlet 34 through the wall 16.

At the joint 28 the diameter of the end of the tube 24 is reduced, so that the capillary pipe 20 can be inserted into the tube 24 and become connected to it by a solder in the gap between the pipe and the tube. The joint 28 is located in the space 12 inside the wall 16, so that the absorption of heat by the refrigerant at the joint 28 is taken care of for refrigerating the air in the space 12. In order to prevent humidity from ambient atmosphere to force its way to the joint 28 and form ice there, which can cause frost bursting, a sealing plug 36 is arranged between the capillary pipe 20 and the tube 26. If a leakage would occur in the joint 28, the refrigerant will leak out into the chamber 38, which is formed in the tube 26 between the plug 36 and the joint, the plug preventing the refrigerant from getting out and the refrigerating apparatus can continue its operation with substantially unchanged refrigerating capacity. If the refrigerant is butane the highest pressure of the refrigerant occurs moreover in the joint when the compressor stands still and the refrigerant circuit thus is pressure equalized. The pressure of the refrigerant is then about 5,5 bar absolute pressure. When the compressor is in operation, the pressure in the evaporator becomes, however, substantially lower, about 0,9 bar absolute pressure.

A tube 40, which conducts the refrigerant back to the compressor, is soldered fast to or in some other way connected to the ends of the tubes 24 and 26 at the joint 30. The tubes 24 and 26 consist suitably of a material with a good heat conductibility, e.g. aluminium, and are arranged in good heat conductive contact with each other.

The tapered end of the tube 24 at the joint 28 can be constituted by a separate part 42 and the capillary pipe 20 can be divided at 44 a distance outside the wall 16 into two parts 20' and 20". On making the arrangement the capillary pipe part 20' is first soldered fast at the joint 28 to the tube part 42. After that the tube part 42 is welded together with the tube 24 at its end 46. The tube 24 is then brought into the outer tube 26, after which the sealing plug 36 is put in its place and the capillary pipe parts 20' and 20" are united to each other by being soldered together in a jointing sleeve 48.

At the embodiment according to FIG. 4 the plug 36 has been substituted by a sealing and heat insulating substance 52, which fills up the chamber 38. The substance 52 has suitably in liquid state been poured into the chamber 38, which first has been brought to take a vertical position with the inlet 32 directed upwards, and after that been allowed to solidify.

At the embodiment according to FIG. 5 the diameter of the end of the tube 26 has been reduced so that it joins with the capillary pipe 20. The plug 36 is here substituted by a soldered joint 54 between the end of the tube 26 and the capillary pipe 20.

We claim:

1. Arrangement at an evaporator (10), for refrigerating air in a space (12), which is confined against ambient atmosphere by a wall (16), the evaporator (10), which is part of a compression refrigerating circuit, being constituted by a tubular element (18), through which a refrigerant flows from a capillary pipe (20) included in the circuit, which pipe is connected to the element at a joint (28) at one end of the element, characterized in that the tubular element (18) comprises an inner tube (24), through which the refrigerant flows, that an outer tube (26) is arranged on the outside of the inner tube, that at said one end (32) of the element (18) the outer tube (26) extends through the wall (16) and that the joint (28) is arranged between the capillary pipe (20) and the inner tube (24), the joint (28) being located inside the wall (16) in a chamber (38) formed in the outer tube (26), and that a sealing means (36; 52; 54) is arranged between the capillary pipe (20) and the outer tube (26) for preventing humidity of the ambient atmosphere (14) from forcing its way into the chamber (38).

* * * * *